US005349177A

United States Patent [19]

Thomas et al.

[11] Patent Number: 5,349,177

[45] Date of Patent: Sep. 20, 1994

[54] IMAGE INTENSIFIER TUBE HAVING A SOLID STATE ELECTRON AMPLIFIER

[75] Inventors: Nils I. Thomas, Roanoke; Robert J. Field, Fincastle, both of Va.

[73] Assignee: ITT Corporation, New York, N.Y.

[21] Appl. No.: 20,650

[22] Filed: Feb. 22, 1993

[51] Int. Cl.[5] ..... H01J 40/14

[52] U.S. Cl. ..... 250/214 VT; 313/528

[58] Field of Search ..... 250/214 VT, 330, 333, 250/370.08; 358/211, 217; 313/525, 526, 528, 529, 532, 542

[56] References Cited

U.S. PATENT DOCUMENTS

| | | | |
|---|---|---|---|
| 3,951,698 | 4/1976 | Wilson et al. | 313/528 |
| 4,431,914 | 2/1984 | Mourou et al. | 250/214 VT |
| 4,628,273 | 12/1986 | Vlasak | 313/522 |
| 4,974,090 | 11/1990 | Kawamura et al. | 358/217 |
| 4,980,772 | 12/1990 | Kawamura et al. | 358/217 |
| 4,990,766 | 2/1991 | Simms et al. | 250/214 VT |

*Primary Examiner*—David C. Nelms
*Assistant Examiner*—K. Shami
*Attorney, Agent, or Firm*—Arthur L. Plevy; Patrick M. Hogan

[57] ABSTRACT

An image intensifier tube that utilizes a photoresponsive layer for producing electrons in response to received radiation, a solid state electron amplifier for multiplying the electrons produced by the photoresponsive layer, a cold cathode for emitting electrons into vacuum, and a phosphor screen for converting impinging electrons into a visible image. The solid state electron amplifier is formed as a semiconductive layer interposed in between a photoresponse layer and a negative electron affinity layer on the photocathode. The solid state electron amplifier receives the electrons produced by the photoresponsive layer, multiplies the electrons and directs the electrons to the negative electron affinity layer. The negative electron affinity layer then directs the electrons through a vacuum to the phosphor screen producing a viewed image.

29 Claims, 3 Drawing Sheets

IMAGE INTENSIFIER TUBE HAVING A SOLID STATE ELECTRON AMPLIFIER

FIELD OF THE INVENTION

The present invention relates to image intensifier tubes that produce visible images from wavelengths of light outside the visible spectrum, and more particularly to such image intensifier tubes wherein a solid state electron amplifier is used to amplify the electron signal within the image intensifier tube.

BACKGROUND OF THE INVENTION

Image intensifier devices are used to amplify low intensity light or convert non-visible light into readily viewable images. Image intensifier devices are particularly useful for providing images from infrared light and have many industrial and military applications. For example, image intensifier tubes are used for enhancing the night vision of aviators, for photographing astronomical bodies and for providing night vision to sufferers of retinitis pigmentosa (night blindness).

Image intensifier tubes are well known and used throughout many industries. Conventionally, image intensifier tubes are identified by the generic generation of their design. In the prior art, there have evolved four conventional generations of image intensifier tubes. Currently in the prior art, image intensifier tubes range from Generation O to the current state of the art Generation III (GEN III) image intensifier tube. As the technology of image intensifier tubes has developed, each successive generation has embodied advantages in performance over the previous generation.

Referring to FIG. 1, a current state of the prior art Generation III (GEN III) image intensifier tube 10 is shown. Examples of the use such a GEN III image intensifier tube in the prior art are exemplified in U.S. Pat. No. 5,029,963 to Naselli, et al., entitled REPLACEMENT DEVICE FOR A DRIVER's VIEWER and U.S. Pat. No. 5,084,780 to Phillips, entitled TELESCOPIC SIGHT FOR DAYLIGHT VIEWING. The GEN III image intensifier tube 10 shown, and in both cited references, is of the type currently manufactured by ITT Corporation, the assignee herein. In the shown GEN III tube 10, infrared energy impinges upon a photocathode 12. The photocathode 12 is comprised of a glass faceplate 14 coated on one side with a antireflection layer 16, a gallium aluminum arsenide (GaAlAs) window layer 17 and gallium arsenide (GaAs) active layer 18. Infrared energy is absorbed in GaAs active layer 18 thereby resulting in the generation of electron/hole pairs. The produced electrons are then emitted into the vacuum housing 22 through a negative electron affinity (NEA) coating 20 present on the GaAs active layer 18.

A microchannel plate (MCP) 24 is positioned within the vacuum housing 22, adjacent the NEA coating 20 of the photocathode 12. Conventionally, the MCP 24 is made of glass having a conductive input surface 26 and a conductive output surface 28. Once electrons exit the photocathode 12, the electrons are accelerated toward the input surface 26 of the MCP 24 by a difference in potential between the input surface 26 and the photocathode 12 of approximately 800 volts. As the electrons bombard the input surface 26 of the MCP 24, secondary electrons are generated within the MCP 24. The MCP 24 may generate several hundred electrons for each electron entering the input surface 26. The MCP 24 is subjected to a difference in potential between the input surface 26 and the output surface 28 which is typically about 900 volts, whereby the potential difference enables electron multiplication.

As the multiplied electrons exit the MCP 24, the electrons are accelerated through the vacuum housing 22 toward the phosphor screen 30 by the difference in potential between the phosphor screen 30 and the output surface 28 of approximately 6000 volts. As the electrons impinge upon the phosphor screen 30, many photons are produced per electron. The photons create the output image for the GEN III image intensifier tube on the output surface of the optical inverter element 31.

The primary performance limiting component of the GEN III device is the MCP 24. The MCP 24 limits the resolution of the tube, has poor noise characteristics, and is both difficult and expensive to manufacture and test. Furthermore, the MCP 24 requires an expensive power supply, shortens tube life by outgassing and provides poor high-light resolution. Since the MCP 24 is glass, outgassing of water occurs over time which degrades the integrity of the environment within the vacuum housing 22. The outgassing mechanism is somewhat overcome by the ion barrier added to the MCP 24, however the presence of the ion barrier reduces the signal to noise ratio (SNR) of the tube. The resolution of the viewed image is lowered by the Nyquist limit of the MCP 24 attributed to the discrete sampling nature of its design, and the fact that the electrons emitted by the MCP 24 have a large radial velocity component which defocuses the image formed on the output screen. The glass material of the microchannel plate 24 also tends to have poor secondary emission characteristics which create a poor SNR. Furthermore, the MCP 24 requires large voltage differentials between its input surface 26 and its output surface 28 and between the photocathode 12 and the input surface 26 to adequately drive the electrons. The power supply needed to maintain such varied electric potentials increases the cost and complexity of the GEN III image intensifier tube 10 and tends to have a low reliability as a result of its complexity.

In the photocathode 12 of the GEN III image intensifier tube 10, there is no applied bias. The operation of the photocathode 10 relies on diffusion of electrons from the GaAs active layer 18 to the negative electron affinity (NEA) coating 20. As such, the GaAs active layer 18 has a doping level which is a compromise between high diffusion length (i.e., low doping), to promote energy absorption, and high emission probability (i.e., high doping), to promote electron emission probability. Since both the photon absorbing and electron emitting characteristics of the photocathode 12 are controlled by the single GaAs active layer 18, the GaAs active layer 18 cannot be doped to a concentration that optimizes either the photon absorbing or electron emitting characteristics, thereby detracting from the operation of both.

In an attempt to avoid the disadvantages associated with conventional MCP's in image intensifier tubes, the prior art proposed an entirely solid state image intensifier device. In the proposed solid state image intensifier device, an avalanche photodiode (APD) is used to multiply electrons from the photocathode in place of the MCP. An example of an avalanche photodiode is shown in U.S. Pat. No. 5,146,296 to Huth, entitled DEVICES FOR DETECTING AND/OR IMAGING SINGLE PHOTOELECTRON. The output image is provided by light emitting diodes (LED's) coupled to the avalanche photodiodes. Between the avalanche photodiodes and the LED's is positioned a light absorbing or reflecting layer to prevent optical feedback. Thus, the device represents an all-solid-state image intensifier. The proposed solid state image intensifier is very difficult to manufacture with gain and noise characteristics approaching those of the GEN III tube. One of the primary problems is the LED output devices, which at best has 10% electron-to-photon conversion efficiency. Not only is it difficult to manufacture the LED to this efficiency, but now the avalanche photodiode (APD) gain must duplicate the electron gain of the MCP, plus the conversion gain of the phosphor, plus an additional factor of 10 to account for the inefficiency of the LED.

Additionally, if red LED's are used, an additional gain may be required to compensate for the low efficiency of the eye in the red wavelengths. APD's capable of producing such high gains are possible, but are unacceptably noisy. Thus special low noise amplifiers must be used, and these require an unreasonably large number of stages to produce sufficient gain to match the GEN III device. The low-noise amplifier stages also have a very exacting structure and are difficult to manufacture. Furthermore, the LED's must be isolated from one another to force the light out and to prevent light-piping sideways through the LED layer. The isolation, etching and contacting of the LED's complicates the processing, and the resulting pixelized output may degrade the image.

Therefore, there exists a need in the art of image intensifier devices for an image intensifier that performs as well, or better then, the GEN III image intensifier tube and avoids the use of a microchannel plate and LED's.

It is therefore a primary objective of the present invention to provide an image intensifier tube that utilizes a solid state electron amplifier to provide an image upon a phosphor screen within a vacuum housing while providing state of the art performance.

SUMMARY OF THE INVENTION

The present invention is an image intensifier tube that utilizes a photocathode with a photo:response layer for producing electrons in response to received radiation, a solid state electron amplifier for multiplying the electrons produced by the photoresponsive layer and a phosphor screen for converting impinging electrons into a visible :image. In a preferred embodiment, the solid state electron amplifier is unistructurely formed as part of the photocathode. That is, the solid state electron amplifier is formed as a semiconductive layer positioned in between a photoresponsive layer and a negative electron affinity (NEA) layer on the photocathode. The solid state electron amplifier receives the electrons produced by the photoresponsive layer, multiplies the electrons and directs the electrons to the negative electron affinity layer. The negative electron affinity layer then emits the electrons which are accelerated through a vacuum to the phosphor screen. Terminals are coupled to the photoresponsive layer on one side of the solid state electron amplifier and to the negative electron affinity layer on the opposite side of the solid electron amplifier. As such, a bias is provided across the solid state electron amplifier as required for its operation.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Figure 2:
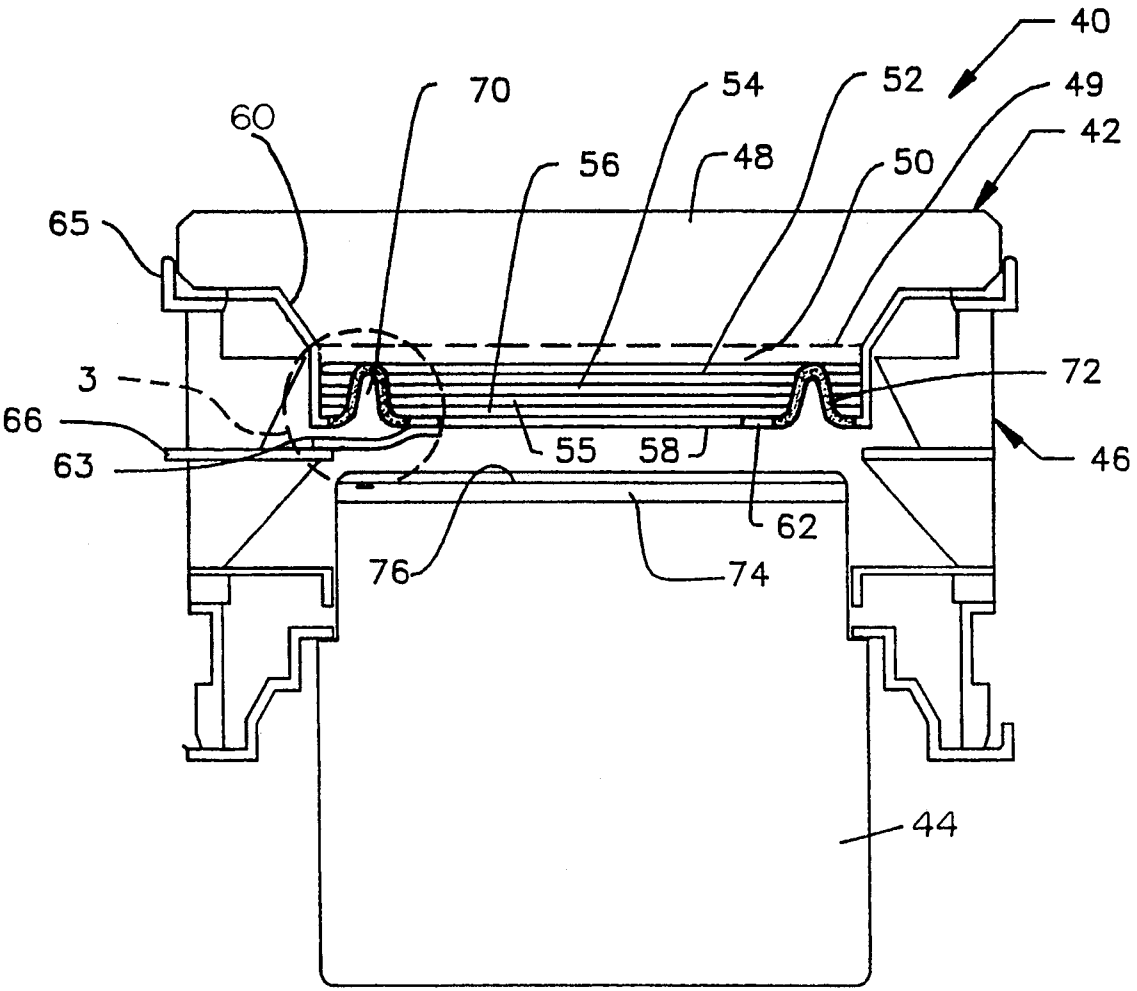
FIG. 2 is a cross-sectional view of one preferred embodiment of the present invention image intensifier tube.
Figure 3:
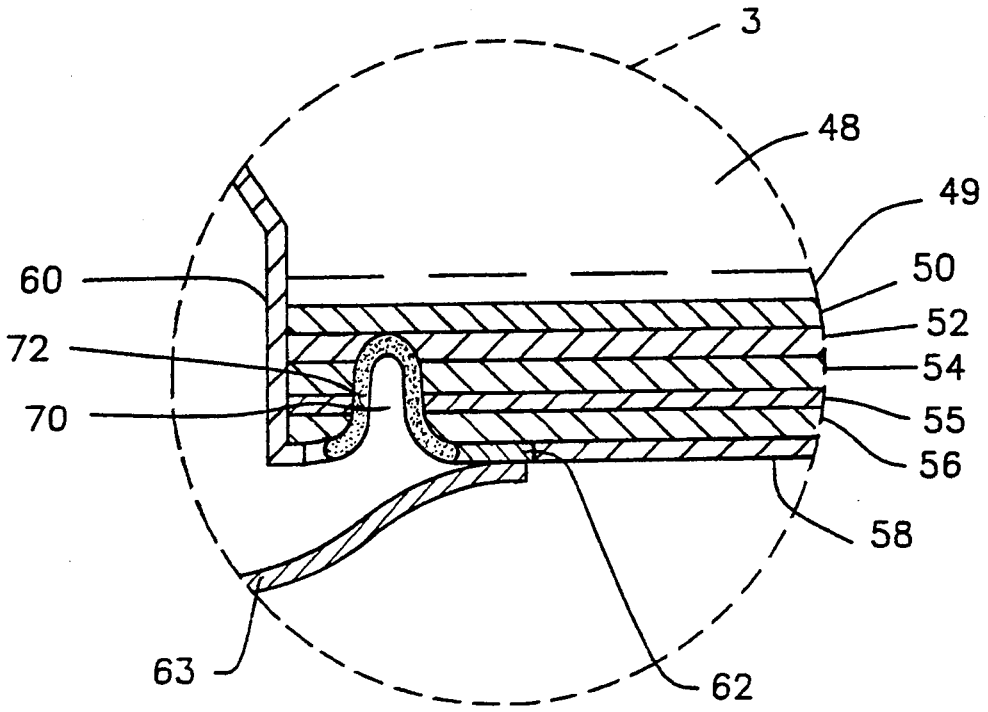
FIG. 3 is an enlarged view of region 3 referenced in FIG. 2 to facilitate a more detailed consideration and discussion.

Referring to FIG. 2 and 3, there is shown one preferred embodiment of the present invention image intensifier tube 40 having a photocathode 42 and an fiber optic element 44 positioned at opposite ends of a vacuum housing 46. The photocathode 42 is comprised of a glass faceplate 48 upon which infrared energy impinges. The glass material of the faceplate 48 can be the same as that currently used in the photocathode of a prior art GEN III image intensifier tube. As is also found in the prior art GEN III image intensifier tube, an antireflection layer 49 is positioned adjacent the glass faceplate 48. A gallium-aluminum-arsenide (GaAlAs) window layer 50 is positioned adjacent the antireflection layer 49 and a gallium arsenide (GaAs) active layer 52 is positioned proximate the GaAlAs window layer 50.

A solid state electron amplifier 54 is positioned proximate the GaAs active layer 52. The solid state electron amplifier 54 can be of any known semiconductor composition but is preferable a GaAs/GaAlAs avalanche photodiode or a gallium-indium-phosphide/aluminum-gallium-indium-phosphorus (GaInP/AlGaInP) avalanche photodiode. A heavily p-doped contact layer 56 is disposed adjacent the solid state electron amplifier 54. The p-doped contact layer 56 is coated with a negative electron affinity (NEA) coating 58, such as a coating of cesium oxide. A heterojunction layer 55 is disposed between the p-doped contact layer 56 and the solid state amplifier 54. The heterojunction layer 55 prevents holes from the p-doped contact layer 56 from entering the solid state electron amplifier 54, while allowing for the free passage of electrons from the solid state electron amplifier 54 into the p-doped contact layer 56.

A conductive coating 60 is deposited on the photocathode 42. The conductive coating 60 is electrically coupled to a first terminal 65 that extends out of the vacuum housing 46. The conductive coating 60 follows the periphery of the photocathode 42 and contacts the GaAlAs window layer 50 and/or the GaAs active layer 52. As a result, the conductive coating 60 electrically interconnects the first terminal 65 to the GaAlAs window layer 50 and/or the GaAs active layer 52. Although the conductive coating 60 can be made of any conductive material, the conductive coating 60 is preferably made of chromium that has been deposited on the photocathode 42 by sputter deposition or a like deposition technique.

A conductive ring 62 is deposited on the p-doped layer 56. A spring contact 63 is electrically coupled to the conductive ring 62. The spring contact 63 is also electrically coupled to a second terminal 66 that extends out beyond the vacuum housing 46. As a result, the spring contact 63 electrically interconnects the second terminal 66 to the p-doped layer 56.

The conductive coating 60 on the periphery of the photocathode 42 is insulated from the conductive ring 62 by the presence of an etched interstice 70 between the conductive ring 62 and the conductive coating 60. The etched interstice 70 transgresses into the GaAs active layer 52 of the photocathode 42, thereby isolating the p-doped contact layer 56 and the solid state electron amplifier 54 from the conductive coating 60. In the embodiment shown in FIG. 3, the etched interstice 70 ends at the interface between the GaAlAs window layer 50 and the GaAs active layer 52. However, it should be understood that the etched interstice 70 may transgress in, to the GaAlAs window layer 50 thereby ensuring that the GaAs active layer 52 is isolated by the etched interstice 70. Furthermore, in a preferred embodiment, the etched interstice 70 is coated with a dielectric 72, such as silicon nitride, thereby creating an edge passivation for the solid state electron amplifier 54.

A phosphor screen 74 is located on the fiber optic element 44 opposite the photocathode 42. The phosphor screen 74 generally includes an aluminum reflector coating 76 to block light from the phosphor screen 74 from re-entering the device through the NEA coating 58, and to filter out low energy electrons. As a result, the reflective coating 76 prevents low energy electrons from impinging upon the phosphor screen 74 and detracting from the produced image.

In operation, infrared energy impinges upon the photocathode 42. The infrared energy travels through the glass faceplate 48, past the antireflection layer 49 and the GaAlAs window layer 50, where the infrared energy is absorbed by the GaAs active layer 52. The GaAs active layer 52 is low-doped to allow greater carrier lifetime and therefore creates a greater photoresponse to absorbed electromagnetic radiation. This differs from prior art GEN III image intensifier tubes which require high doping in the GaAs active layer to produce good electron emission probability in the NEA coating. As the GaAs layer 52 absorbs the electromagnetic radiation, electron/hole pairs are created and the electrons diffuse into the solid state electron amplifier 54 where they are multiplied. Alternatively, the amplifier bias can be extended across the GaAs layer 52 to direct electrons into the solid state amplifier 54. As such, the GaAs layer 52 can be an extension of the solid state amplifier, but without electron multiplication. The multiplied electrons exiting the solid state electron amplifier 54 then pass through the heterojunction layer 55, p-doped contact layer 56 and into the NEA coating 58. The presence of the heavily p-doped contact layer 56 above the NEA coating 58 promotes electrical conductivity and improves the electron emission probability of the NEA coating 58.

Consequently, in the present invention, a low doping concentration can be maintained in the GaAs active layer 52 to promote photoresponse, and a high doping concentration can be maintained proximate the NEA coating 58 to promote electron emission probability. By having separate photon absorbing and electron emitting layers, both layers can be doped to optimal values. This differs from prior art GEN III image intensifier tubes which have only one absorbing/emitting layer that requiring a compromise in doping concentrations.

Referring to FIG. 3 it can be seen that the GaAlAs window layer 50 is coupled to the conductive coating 60, which in turn is coupled to a first terminal 65. As such, a bias can be applied to the GaAlAs window layer 50 by applying an electrical potential to the first terminal 65. Similarly, the conductive ring 62 contacts both the NEA coating 58 and the p-doped contact layer 56. The conductive ring 62 is coupled to the second terminal 66 via the spring contact 64. As such, a bias can be realized at both the NEA coating 58 and the p-doped contact layer 56 by applying a electrical potential to the second terminal 66. It will therefore be understood that by applying differing voltages to the first terminal 65 and second terminal 66, a voltage drop can be created across the GaAs active layer 52 which can be used to actively drive electrons into the solid state electron amplifier 54, thereby eliminating reliance upon diffusion.

Figure 1:
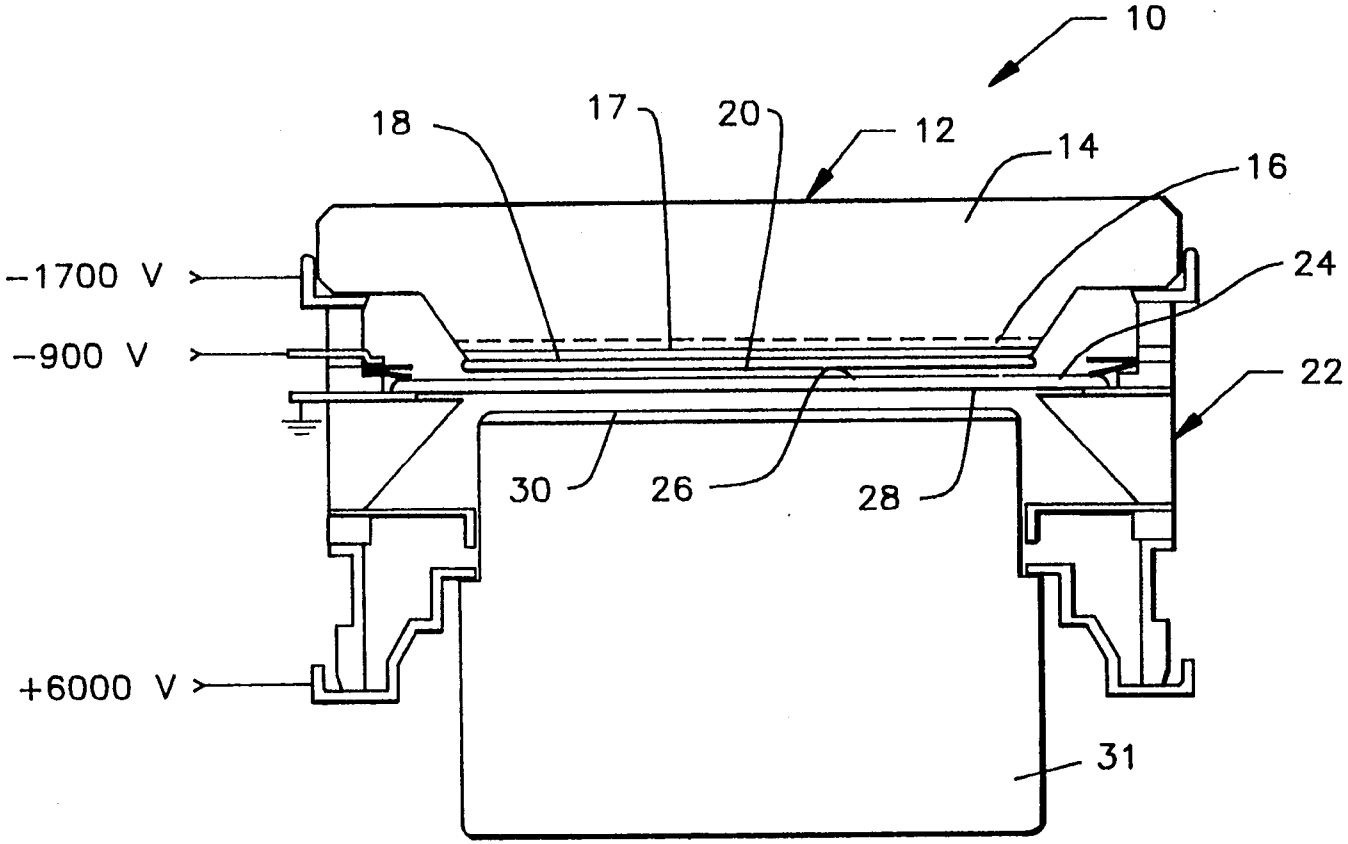
(PRIOR ART) FIG. 1
FIG. 1 is a cross-sectional view of a prior art GEN III image intensifier tube.

As the electrons exit the NEA coating 58 they are accelerated toward the phosphor screen 74 by the presence of a positive electrical bias applied to the phosphor screen 74. As compared to the prior art GEN III image intensifier tube of FIG. 1, the multiplied electrons leaving the NEA coating 58 of the present invention have a lower energy than electrons leaving the MCP in the prior art GEN III tube. Consequently, electrons leaving the NEA coating 58 have a relatively low lateral velocity. This allows the distance in between the NEA coating 58 and the phosphor screen 74 to be increased over the prior art, without a resulting loss in resolution. The increased spacing in between the NEA coating 58 and phosphor screen 74 allows for higher voltages to be applied to the phosphor screen 74 without arcing. Higher voltages at the phosphor screen 74 results in an increase in the phosphor conversion gain which therefore, reduces the gain required of the solid state amplifier 54.

The decreased lateral velocity of electrons exiting the NEA coating 58 provides the present invention image intensifier tube 10 with better resolution in high light level performance. The gain of the present invention image intensifier tube 10 can be further reduced, for operation at high light levels, by reducing the bias voltage across the solid state electron amplifier 54, reducing the voltage applied to the phosphor screen 74, gating the bias of the solid state electron amplifier 54 by using a time-proportional signal and/or adding another contact to the solid state electron amplifier 54 to drain electrons.

The present invention image intensifier tube 10 can be formed into the same shape as a prior art GEN III image intensifier tube. For this reason, it will be understood that the present invention image intensifier tube 10 can be used in any application to which a GEN III image intensifier tube can be applied. It will be further understood that the image intensifier tube described herein is merely exemplary and that a person skilled in the art may make variations and modifications to the described embodiment utilizing functionally equivalent components to those specifically described. More particularly, it should be understood that the present invention need not be applied to infrared image intensifiers, but may also be used in ultra-violet or X-ray image intensifier tubes. Similarly, the present invention can be used to replace the electron multiplying section in a reflection mode electron multiplier tube, by using a standard primary cathode followed by the solid state amplifier. Additionally, a mixture of III–V materials (GaAs, GaAlAs, etc.) may be incorporated using heteroeptaxial techniques such as one material for the window layer, another for the active layer and others for the amplifier and emitter contact in order to optimize the properties of each layer of the integral structure. Furthermore, the image intensifier tube may be modified in its structure to include a charged-coupled device (CCD), either coupled to the output screen of the image intensifier tube for electronic output imaging or in place of the phosphor screen so as to create direct electron bombardment of the CCD for intensified cameras. All such variations and modifications are intended to be included within the scope of this invention as defined by the appended claims.

What is claimed is:

1. An image intensifier tube, comprising:

photocathode means for producing electrons in response to received electromagnetic radiation, said photocathode means including absorptive means for absorbing said received electromagnetic radiation and a separate emissive means for emitting electrons;

solid state electron amplifier means for multiplying electrons produced by said photocathode means, wherein said solid state electron amplifier means is interposed between said absorptive means and said emissive means; and imaging means for creating a visible image in response to electrons emitted from said emissive means.

2. The image intensifier tube according to claim 1, further comprising a means for biasing electrons through said solid state electron amplifier means.

3. The image intensifier tube according to claim 1, wherein said imaging means includes a phosphor screen.

4. The image intensifier tube according to claim 1, wherein said photocathode means includes a glass faceplate coated with at least one photoresponsive layer for emitting electrons in response to said received electromagnetic radiation.

5. The image intensifier tube according to claim 4, wherein said solid state electron amplifier means is positioned proximate said photoresponsive layer for receiving and multiplying electrons emitted by said photoresponsive layer.

6. The image intensifier tube according to claim 5, wherein a negative electron affinity layer is positioned proximate said solid state electron amplifier means for receiving multiplied electrons produced by said solid state electron amplifier means and emitting electrons to said imaging means.

7. The image intensifier tube according to claim 1, wherein a first terminal is coupled to said absorptive means and a second terminal is coupled to said emissive means thereby enabling an electrical bias to be created between said absorptive means and said emissive means across said solid state amplifier means by varying voltages applied to said first terminal and said second terminal.

8. The image intensifier tube according to claim 6, wherein a p-doped layer is juxtaposed between said solid state electron amplifier means and said negative affinity layer to promote electron emission probability in said negative affinity layer.

9. The image intensifier tube according to claim 7, wherein said photoresponsive layer includes a gallium arsenide layer.

10. The image intensifier tube according to claim 9, wherein said solid state electron amplifier means includes a semiconductor avalanche photodiode selected from a group of semiconductive materials consisting of gallium-arsenide/gallium-aluminum-arsenide and gallium-indium-phosphorus/aluminum-gallium-indium-phosphorus.

11. The image intensifier tube according to claim 8, wherein p-doped layer is doped at a concentration that optimizes electron emission probability within said negative affinity layer.

12. The image intensifier tube according to claim 8, wherein a heterojunction layer is disposed between said solid state amplifier and said p-doped layer, whereby said heterojunction layer prevents holes from entering said solid state amplifier from said p-doped layer.

13. An image intensifier device comprising:

a vacuum housing;

photocathode means positioned at one end of said vacuum housing for producing electrons in response to received electromagnetic radiation;

phosphor screen means positioned within said vacuum housing for creating visible light in response to electrons impinging thereupon; and biasing means for causing electrons produced by said photocathode means to impinge upon said phosphor screen means; and solid state electron amplifier means positioned proximate said photoresponsive layer for receiving and multiplying electrons emitted by said photoresponsive layer within said vacuum housing before the electrons impinge upon said phosphor screen means.

14. The image intensifier device according to claim 13, wherein said photocathode means includes a glass faceplate having at least one photoresponsive layer thereon for emitting electrons in response to said received electromagnetic radiation.

15. The image intensifier device according to claim 14, wherein a negative electron affinity layer is positioned proximate said solid state electron amplifier means for receiving multiplied electrons produced by said solid state electron amplifier means and emitting electrons to said phosphor screen means.

16. The image intensifier device according to claim 14 further including a second biasing means for biasing electrons produced by said photoresponsive layer through said solid state electron amplifier means.

17. The image intensifier device according to claim 15, wherein a p-doped layer is juxtaposed between said solid state electron amplifier means and said negative electron affinity layer, said p-doped layer having a doping concentration optimizing the electron emission probability of said negative affinity layer.

18. The image intensifier device according to claim 17, wherein a heterojunction layer is juxtaposed between said solid state electron amplifier means and said p-doped layer, whereby said heterojunction layer prevents holes from entering said solid state electron amplifier means from said p-doped layer.

19. The image intensifier device according to claim 14, wherein said photoresponsive layer is doped at a concentration optimizing the photoresponse of said photoresponsive layer.

20. The image intensifier device according to claim 17, wherein said photoresponsive layer includes a gallium-aluminum-arsenide window layer and a gallium-arsenide active layer.

21. The image intensifier device according to claim 20, wherein said solid state electron amplifier means includes a semiconductor avalanche photodiode.

22. The image intensifier device according to claim 21, wherein said semiconductor avalanche photodiode is selected from a group of semiconductive materials consisting of gallium-arsenide/gallium-aluminum-arsenide and gallium-indium-phosphorous /aluminum-gallium-indium-phosphorus.

23. The image intensifier device according to claim 22, wherein said negative affinity layer includes cesium oxide.

24. A photocathode/electron amplifier assembly for use in an image intensifier tube comprising:

a glass faceplate through which selected frequencies of electromagnetic radiation may pass;

a photoresponsive layer joined to said glass faceplate for producing electrons in response to said electromagnetic radiation;

at least one solid state amplifier stage joined to said photoresponsive layer for multiplying electrons produced by said photoresponsive layer;

a p-doped layer;

a heterojunction layer disposed between said at least one solid state amplifier stage and said p-doped layer, wherein said heterojunction layer prevents the flow of holes from said p-doped layer into said at least one solid state amplifier; and a negative electron affinity layer joined to said p-doped layer for emitting electrons received from said at least one solid state amplifier stage through said p-doped layer.

25. The assembly according to claim 24 further including a biasing means for biasing electrons produced by said photoresponsive layer through said at least one solid state amplifier stage.

26. The assembly according to claim 24, wherein said p-doped layer is doped at a concentration to optimize the electron emission probability of said negative electron affinity layer.

27. The assembly according to claim 24, wherein said at least one solid state amplifier stage includes a semiconductor avalanche photodiode.

28. The assembly according to claim 27, wherein said semiconductor avalanche photodiode is selected from a group of semiconductive materials consisting of gallium-arsenide/gallium-aluminum-arsenide and gallium-indium-phosphorous/aluminum-gallium-indium-phosphorus.

29. The assembly according to claim 27, wherein said photoresponsive layer includes a gallium-aluminum-arsenide window layer and a doped gallium-arsenide active layer, wherein said active layer is doped at a concentration to optimize photoresponse to said selected frequencies of electromagnetic radiation.

* * * * *